US012497969B2

(12) United States Patent
Umematsu et al.

(10) Patent No.: US 12,497,969 B2
(45) Date of Patent: Dec. 16, 2025

(54) BLOWER

(71) Applicant: SHINANO KENSHI KABUSHIKI KAISHA, Nagano (JP)

(72) Inventors: Akishige Umematsu, Nagano (JP); Naomasa Yoshida, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 22 days.

(21) Appl. No.: 18/421,360

(22) Filed: Jan. 24, 2024

(65) Prior Publication Data

US 2024/0287992 A1 Aug. 29, 2024

(30) Foreign Application Priority Data

Feb. 27, 2023 (JP) ..... 2023-028001

(51) Int. Cl.
*F04D 13/06* (2006.01)
*F04D 29/28* (2006.01)
*F04D 29/42* (2006.01)

(52) U.S. Cl.
CPC ..... *F04D 13/0633* (2013.01); *F04D 29/281* (2013.01); *F04D 29/4226* (2013.01)

(58) Field of Classification Search
CPC ..... F04D 13/0633; F04D 29/281; F04D 29/4226; F04D 29/059; F04D 25/08; F04D 29/056; F04D 29/441; F04D 29/584; F04D 29/626; F04D 29/667; F04D 29/668
See application file for complete search history.

(56) References Cited

U.S. PATENT DOCUMENTS 3,663,117 A * 5/1972 Warren ..... C02F 3/205 261/93
5,121,605 A * 6/1992 Oda ..... F01D 5/10 310/156.28
5,904,471 A * 5/1999 Woollenweber .... F04D 29/4213 417/423.9
6,129,524 A * 10/2000 Woollenweber ..... F04D 25/082 417/366
6,293,769 B1 * 9/2001 Radermacher ..... H02K 9/227 417/357

(Continued)

FOREIGN PATENT DOCUMENTS

JP 2018-155237 10/2018
JP 2020-41523 3/2020

(Continued)

OTHER PUBLICATIONS

Office Action dated Dec. 24, 2024 in corresponding Japanese Patent Application No. 2023-028001.

*Primary Examiner* — Jesse S Bogue
(74) *Attorney, Agent, or Firm* — Stephen J. Weyer Esq.; Stites & Harbison, PLLC

(57) ABSTRACT

A blower improving heat dissipation of a bearing and achieving long operating life without increasing the number of parts is provided. A bearing holding portion rotatably supporting a motor shaft, to which a rotor of a motor and an impeller are assembled on two longitudinal sides, respectively via a bearing, is assembled to a fan casing, and part of the bearing holding portion adjacent to the impeller extends to a position facing an air path and forms part of the air path.

4 Claims, 3 Drawing Sheets

(56) References Cited

U.S. PATENT DOCUMENTS

| | | | | |
|---|---|---|---|---|
| 8,636,479 | B2 * | 1/2014 | Kenyon | H02K 3/522 417/423.5 |
| 9,371,834 | B2 * | 6/2016 | Daugaard | F04D 29/2288 |
| 9,784,282 | B2 * | 10/2017 | Robson | F04D 29/60 |
| 10,001,141 | B2 * | 6/2018 | King | F04D 29/584 |
| 10,233,935 | B2 * | 3/2019 | Kanai | H02P 29/00 |
| 10,598,215 | B2 * | 3/2020 | Kanai | F16C 21/00 |
| 11,699,937 | B2 * | 7/2023 | Maruyama | F04D 29/053 415/203 |
| 2008/0084140 | A1 * | 4/2008 | Kim | F04D 25/064 310/67 R |
| 2013/0051983 | A1 * | 2/2013 | Clothier | F04D 29/4213 415/121.3 |
| 2015/0337850 | A1 * | 11/2015 | An | F04D 29/284 417/423.13 |
| 2018/0156233 | A1 * | 6/2018 | Sawada | F04D 25/06 |
| 2018/0163747 | A1 * | 6/2018 | Hayamitsu | A47L 9/2842 |
| 2018/0223874 | A1 * | 8/2018 | Maruyama | F04D 29/059 |
| 2019/0021562 | A1 * | 1/2019 | Shiozawa | F04D 29/4253 |
| 2020/0300261 | A1 * | 9/2020 | Umematsu | F04D 29/4233 |
| 2021/0254632 | A1 * | 8/2021 | Umematsu | F04D 19/002 |

FOREIGN PATENT DOCUMENTS

| | | |
|---|---|---|
| JP | 2020-153331 | 9/2020 |
| JP | 2021-131021 | 9/2021 |

* cited by examiner

BLOWER

CROSS-REFERENCE TO RELATED APPLICATION

This application is based upon and claims the benefit of priority of the prior Japanese Patent Application No. 2023-028001, filed on Feb. 27, 2023, and the entire contents of which are incorporated herein by reference.

TECHNICAL FIELD

The present disclosure relates to a blower used in, for example, a medical instrument, an industrial apparatus, or a consumer appliance.

BACKGROUND ART

A blower has an integral assembly of a resin fan casing, which accommodates an impeller and which is provided with an air path where compressed air flows, and a metal or resin motor casing, which accommodates a motor that drives the impeller to rotate. Driving the motor to rotate the impeller allows the outside air to be suctioned into the fan casing from an axial direction and the compressed air to be delivered from radially outward.

For example, in a blower 50 illustrated in FIG. 3, a rotor 53 is assembled to a motor shaft 52 disposed in a motor casing 51, and an impeller 55 is assembled to the motor shaft 52 extending into a fan casing 54. For the more manageable balance of a rotating element, a cylindrical bearing housing 56 is provided between the rotor 53 assembled to the motor shaft 52 and the impeller 55, and a pair of bearings 57 are assembled into the bearing housing 56. The motor shaft 52 is rotatably supported by the pair of bearings 57, and a metal material (stainless steel) is used for the bearing housing 56.

When the outside air axially suctioned into the fan casing 54 by the rotation of the impeller 55 leaks into the motor casing 51 via a gap present, for example, around the motor shaft 52, a desired static pressure cannot be obtained. Therefore, to improve airtightness, the motor casing 51 and the fan casing 54 are hermetically sealed with a seal member 58 such as an O-ring (refer to JP-A-2021-131021).

SUMMARY OF INVENTION

Technical Problem

The blower is required to have performances such as high pressure, high flow rate, and high response, while downsizing and weight reduction are needed. The trend, therefore, is moving toward downsizing the impeller of the blower to enable higher rotation.

When the impeller rotates at high speed to meet the demand of the high pressure and the high flow rate, the heat generated from the bearings increases, resulting in reduced life. Furthermore, a resin material is often used for the fan casing to meet the demand of the downsizing and the weight reduction. In this case, the resin material reduces the heat dissipation of the blower, compared with the metal material. This further increases the heat generated from the bearings and reduces the life.

To suppress the vibration of the motor casing, the bearing housing is assembled to the resin fan casing via an anti-vibration member (e.g., rubber). This anti-vibration member and the fan casing are low in heat dissipation and structured to suppress airflows around the bearings. Bearing temperature, therefore, tends to rise, causing the reduced life.

If the resin fan casing is changed to a metal fan casing, the heat dissipation of the bearings improves. However, as the blower's weight increases, the heat generated from the motor propagates to the air path via the fan casing, and the temperature of the delivered air increases more than needed.

Solution to Problem

The present invention has been accomplished under the circumstances. An object of the present invention is to provide a blower capable of improving the heat dissipation of bearings disposed between an impeller and a motor and achieving an extended lifespan without increasing the number of parts.

To attain the object, the present invention is configured as follows.

A blower includes an integral assembly of a fan casing accommodating an impeller and a motor casing accommodating a motor that drives the impeller to rotate, and suctions air from an axially central portion of the fan casing and delivering the air from an air path provided radially outward, a bearing rotatably supporting a motor shaft to which a rotor of the motor and the impeller being assembled on two longitudinal sides, respectively, and a metal bearing holding portion holding the bearing being disposed between the impeller and the motor, and the bearing holding portion extending radially outward to a position facing the air path and forming part of the air path.

According to the configurations, part of the metal bearing holding portion disposed between the impeller and the motor extends to the position facing the air path to form part of the air path. Therefore, when the air is suctioned from the axially central portion of the fan casing in response to the rotation of the impeller and delivered from the air path provided radially outward, the bearing holding portion is cooled to enable the enhancement of heat dissipation of the bearings.

Furthermore, there is no need to change a material for the fan casing to enhance the heat dissipation; therefore, it is possible to avoid a great increase in the weight of the blower and prevent a great increase in a temperature of the delivered air.

A tip end side of a flange portion of the bearing holding portion extending radially outward to the air path, which is disposed radially outward about the motor shaft, may form part of the air path.

This can release the heat generated from the bearings to the air path through the flange portion provided in the bearing holding portion, enhance the heat dissipation of the bearings, and achieve extended lifespan.

The flange portion may be formed integrally with the bearing holding portion or may be separately assembled to the bearing holding portion by a combination of separate elements.

Integrating the flange portion with the bearing holding portion can reduce the number of parts and improve rigidity. Furthermore, separately forming the flange portion from the bearing holding portion may increase the number of parts but improve yield.

In this way, the bearing holding portion made of metal can improve heat conductivity and accelerate the heat dissipation of the bearings through the flange portion.

The impeller may include a plurality of first blades formed standing on one surface of a rotating plate facing an intake opening portion; and a plurality of second blades formed standing on the other surface of the rotating plate facing the flange portion.

In this way, the plurality of second blades also formed standing on the other surface of the rotating plate facing the flange portion can enhance the heat dissipation of the bearings through the flange portion and offset the stress of trying to float along the axial direction of the bearing holding portion.

The bearing holding portion may be assembled to the fan casing via an anti-vibration member.

In this way, the rotation vibration of the motor shaft to which the impeller and the rotor are assembled can be absorbed by the anti-vibration member and prevented from propagating to the fan casing.

Moreover, a gap may be provided between the flange portion of the bearing holding portion facing the air path and the fan casing. In this case, the blower is structured to suppress airflows around the bearings from leaking to the air path by the anti-vibration member. This can facilitate the release of hot air around the bearings to the air path via the gap between the flange portion of the bearing holding portion and the fan casing through the flange portion.

Advantageous Effects of Invention

According to the present invention, it is possible to provide a blower capable of improving the heat dissipation of bearings disposed between an impeller and a motor and achieving extended lifespan without increasing the number of parts.

DESCRIPTION OF EMBODIMENTS

First Embodiment

Embodiments of a blower according to the present invention will be described hereinafter with reference to the accompanying drawings. Schematic configurations of the blower will first be described with reference to FIG. 1.

Figure 1:
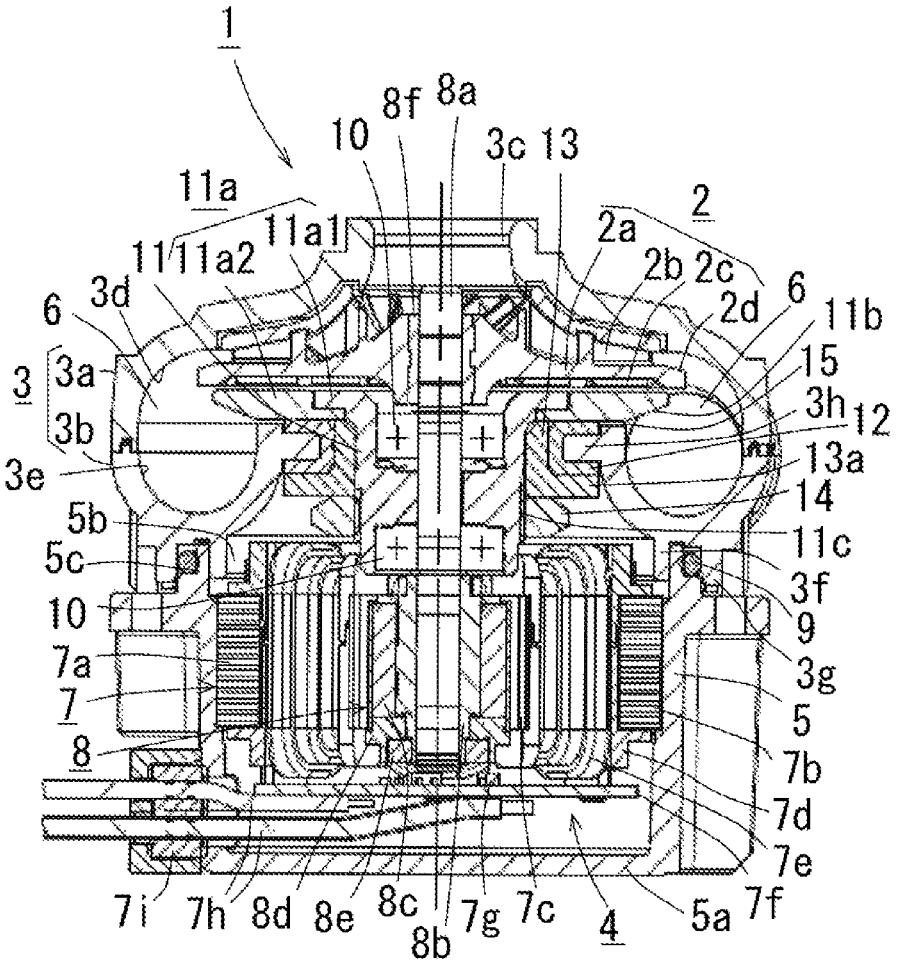
FIG. 1 is a cross-sectional view of a blower according to a first embodiment.

As illustrated in FIG. 1, a blower 1 has an integral assembly of a fan casing 3, which accommodates an impeller 2, and a motor casing 5, which accommodates a motor 4 that drives the impeller 2 to rotate. While a DC brushless motor is used as the motor 4, and an inner-rotor type motor is used in the present embodiment. When the motor 4 drives the impeller 2 to rotate, air is suctioned from an axially central portion of the fan casing 3 and delivered from an annular air path 6 provided radially outward.

The motor casing 5 accommodates the inner-rotor type motor 4. Specifically, a stator 7 is assembled to an inner wall surface of the motor casing 5. The stator 7 is configured so that an annular core back portion 7*b* of a stator core 7*a* is press-fitted. The stator core 7*a* may be fixed by adhesive bonding instead of press-fit. A plurality of pole teeth 7*c* protrude radially inward from the core back portion 7*b*. The stator core 7*a* is covered with an insulator 7*d*, and a motor coil 7*e* is wound around the pole teeth 7*c* via the insulator 7*d*.

A rotor 8 is configured so that a cylindrical yoke 8*b* is assembled to one end side (lower end side in FIG. 1) of a motor shaft 8*a* around the motor shaft 8*a* and that an annular rotor magnet 8*c* is assembled concentrically to an outer circumference of the yoke 8*b*. The rotor magnet 8*c* is magnetized to alternately form N poles and S poles circumferentially.

Furthermore, the insulator 7*d* provided near a bottom portion 5*a* of the motor casing 5 is supported on a motor substrate 7*f*. A lead wire of the motor coil 7*e* is connected to the motor substrate 7*f*, and a feeder circuit for the motor coil 7*e* is provided above the motor substrate 7*f*. A magnetic sensor 7*g* (such as a Hall IC) is also provided on the motor substrate 7*f*. A holder 8*d* formed from a non-magnetic material is assembled to the yoke 8*b* on a shaft end of the motor shaft 8*a*, and an annular sensor magnet 8*e* is assembled to the holder 8*d* to be opposed to the magnetic sensor 7*g*. The sensor magnet 8*e* is magnetized to correspond to a magnetic pole of the rotor magnet 8*c*, and a current-carrying direction in which a current flows in the motor coil 7*e* is switched in response to the magnetic pole detected by the magnetic sensor 7*g*. A connecting wire 7*h* is connected to the motor substrate 7*f*, and the connecting wire 7*h* is spread along the bottom portion 5*a* of the motor casing 5. The connecting wire 7*h* is led out of the motor casing 5 via a grommet 7*i* assembled to the motor casing 5.

Moreover, the other end side (upper end side in FIG. 1) of the motor shaft 8*a* extends into the fan casing 3, and the impeller 2 is integrally assembled to a shaft end of the motor shaft 8*a* via an insert sleeve 8*f*. The impeller 2 includes a plurality of first blades 2*b* formed standing on an upper surface of a disc-shaped rotating plate 2*a* from a central portion through an outer circumferential portion of the rotating plate 2*a*. Second blades 2*c* are also formed standing on a lower surface of the rotating plate 2*a* near the outer circumferential portion. In this way, the plurality of second blades 2*c* also formed standing on the lower surface of the rotating plate 2*a* can enhance heat dissipation of bearings 10, to be described later, and offset a stress of trying to float along an axial direction of a bearing holding portion 11. The second blades 2*c* are not necessarily provided and may be omitted depending on the product.

Furthermore, the fan casing 3 is formed from a combination of a first casing 3*a* and a second casing 3*b*. An intake opening portion 3*c* is provided in a central portion of the first casing 3*a*, and an air path radially outward along the first blades 2*b* is formed between an inner wall surface of the first casing 3*a* and the rotating plate 2*a* of the impeller 2. A center of the intake opening portion 3*c* does not necessarily coincide with an axis of the motor shaft 8*a* and may be present in a range in which a position of the intake opening portion 3*c* is near an axially central portion of the fan casing 3 and the blower 1 can operate without efficiency reduction. A first curved portion 3*d* curved to have a recess inner wall surface continuous with the air path is provided around an outer circumference of the first casing 3*a*.

The second casing 3*b* is disposed to be opposed to the first casing 3*a* on an outer circumference of the first casing 3*a*, and a second curved portion 3*e* curved to have a recess inner wall surface is provided around the second casing 3*b* to be opposed to the first curved portion 3*d*. The recessed surface of the first curved portion 3*d* is combined with the recessed surface of the second curved portion 3*e* to form the annular air path 6. An outer circumferential end portion 2*d* of the rotating plate 2*a* of the impeller 2 extends to a position facing the air path 6 near the first curved portion 3*d*. The first casing 3*a* and the second casing 3*b* are assembled by fitting a projecting portion into a recess portion provided in outer circumferential end portions of the first curved portion 3*d* and the second curved portion 3*e*.

An annular fitting wall 3*f* protrudes from the second casing 3*b*, and this fitting wall 3*f* is fitted into an opening portion 5*b* of the motor casing 5 to assemble the fan casing 3 and the motor casing 5. In addition, an annular seal wall 3*g* protrudes radially outward from the second casing 3*b* to be side by side with the fitting wall 3*f*. A seal member (O-ring) 9 is put between the seal wall 3*g* and an outer wall 5*c* of an opening of the motor casing 5 to close connections between the fan casing 3 and the motor casing 5. It is noted that the fan casing 3 and the motor casing 5 are assembled to be integral by superimposing corresponding screw holes on each other and fitting a screw, not illustrated, into the screw holes.

A pair of bearings 10 (rolling bearings) are assembled between the impeller 2 and the rotor 8 assembled to respective end portions of the motor shaft 8*a*. The pair of bearings 10 are held by the bearing holding portion 11 and rotatably support the motor shaft 8*a*. The bearing holding portion 11 is a cylindrical metal body of high heat conductivity (e.g., stainless steel), and the pair of bearings 10 are assembled into a cylindrical hole. The motor shaft 8*a* is assembled by inserting the pair of bearings 10 and rotatably supported by the pair of bearings 10.

The bearing holding portion 11 is disposed adjacent to the impeller 2, and a flange portion 11*a* provided in an end portion of the bearing holding portion 11 near the impeller 2 extends radially outward. The flange portion 11*a* is disposed to be opposed to the rotating plate 2*a* of the impeller 2, parts near an outer circumferential end portion 11*b* of the flange portion 11*a* extend to a position facing the air path 6 to form part of the air path 6. This can release the heat generated from the pair of bearings 10 to the air path 6 through the flange portion 11*a* provided in the bearing holding portion 11, enhance the heat dissipation of the bearings 10, and achieve extended lifespan. The outer circumferential end portion 11*b* of the flange portion 11*a* tapers to have a tapered surface. A curved surface along the air path 6 may be formed as an alternative to the tapered surface. In the present embodiment, the flange portion 11*a* is assembled to the bearing holding portion 11 by assembling a combination of a plurality of annular portions. Specifically, an annular first flange portion 11*a*1 formed integrally with a main body of the bearing holding portion 11 and an annular second flange portion 11*a*2 superimposed on the first flange portion 11*a*1 are assembled by superimposing stepped portions on each other. In this way, configuring the flange portion 11*a* from the two parts can save manufacturing costs without wasting a metal material.

An annular flange portion 3*h* protrudes radially inward on a side wall surface of an inner circumference of the second curved portion 3*e* of the second casing 3*b*. The flange portion 11*a* of the bearing holding portion 11 is superimposed on one axial surface side (upper surface side) of this flange portion 3*h* via an anti-vibration member 12 (e.g., rubber). Furthermore, a cylindrical metal collar 13 is inserted into a central hole of the flange portion 3*h* covered with the anti-vibration member 12, and a flange portion 13*a* of the collar 13 is superimposed on the other axial surface side (lower surface side) of the flange portion 3*h*. In this way, a nut 14 is screwed into a screw portion 11*c* provided on an outer circumferential surface of the bearing holding portion 11 with the flange portion 3*h* put between the flange portion 11*a* of the bearing holding portion 11 and the flange portion 13*a* of the collar 13 in the axial direction via the anti-vibration member 12, thus fixing an assembly position of the bearing holding portion 11 with respect to the motor shaft 8*a*. In this way, the anti-vibration member 12 interposed between the bearing holding portion 11 and the fan casing 3 can absorb a rotational vibration of the motor shaft 8*a* to which the impeller 2 and the rotor 8 are assembled, to prevent the rotational vibration from propagating to the fan casing 3.

As described above, the outer circumferential end portion 2*d* of the flange portion 11*a* of the bearing holding portion 11 adjacent to the impeller 2 extends to the position facing the air path 6 and forms part of the air path 6. Therefore, when the air is suctioned from the axially central portion of the fan casing 3 by the rotation of the impeller 2 and compressed air is delivered from the air path 6 provided radially outward, the bearing holding portion 11 is cooled through the metal flange portion 11*a* to enable enhancement of the heat dissipation of the bearings 10.

Furthermore, there is no need to change the material for the fan casing 3 to a metal material with high heat conductivity to enhance heat dissipation. Therefore, it is possible to avoid a great increase in a weight of the blower 1 and prevent a great increase in a temperature of the delivered air.

Furthermore, a gap 15 may be provided between the flange portion 11*a* facing the air path 6 and the fan casing 3 (second casing 3*b*). While the blower 1 is structured so that the anti-vibration member 12 can suppress the leakage of airflows around the bearings 10 to the air path 6, this structure can facilitate the release of hot air around the bearings 10 to the air path 6 via the gap 15 through the flange portion 11*a* of the bearing holding portion 11.

Figure 3:
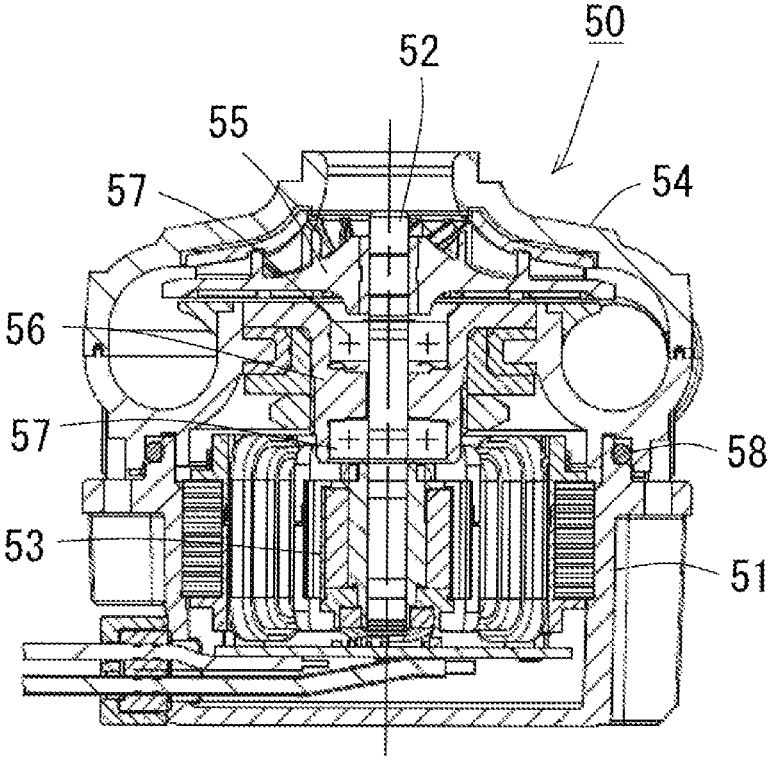
FIG.3 PRIOR ART
FIG. 3 is a cross-sectional view of a conventional blower.

An experiment was conducted to measure a temperature difference in the bearing holding portion 11 between the conventional structure illustrated in FIG. 3 and the structure of the first embodiment illustrated in FIG. 1 after the blower 1 was driven to rotate in the same conditions. It turned out that the configurations of the first embodiment were lower in temperature by about 7.3° C. and produced a sufficient cooling effect on the bearings 10 and the bearing holding portion 11.

Second Embodiment

Another embodiment of the blower 1 according to the present invention will be described with reference to FIG. 2. The motor casing 5 that configures the blower 1 and that accommodates the motor 4 and the fan casing 3 that configures the blower 1 and that accommodates the impeller 2 are similar in configurations to those in the first embodiment. The same reference signs denote the same members, and descriptions of the same members in the first embodiment shall apply to the second embodiment.

Figure 2:
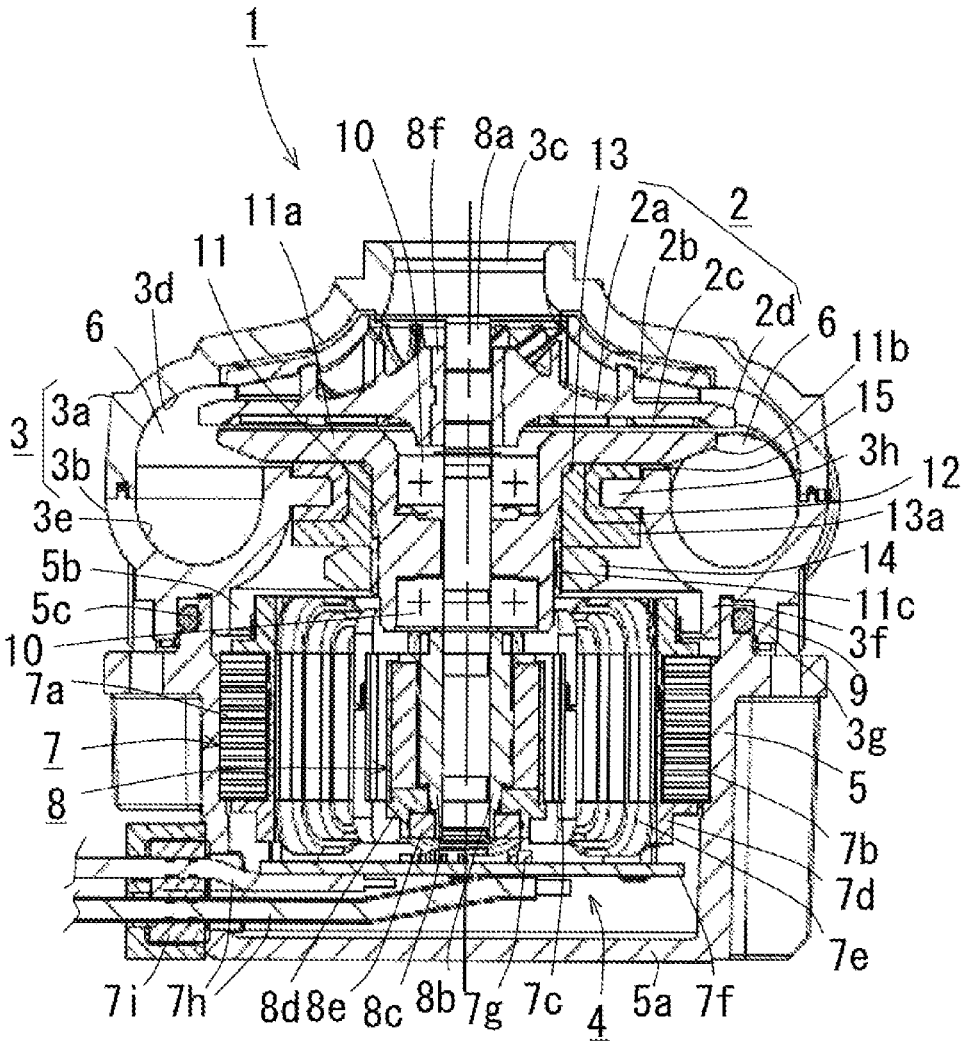
FIG. 2 is a cross-sectional view of a blower according to a second embodiment.

In FIG. 2, the pair of bearings 10 provided between the impeller 2 and the rotor 8 are held by the bearing holding portion 11 made of metal with high heat conductivity (e.g., stainless steel), and the pair of bearings 10 rotatably support the motor shaft 8*a*. This structure is similar to that illustrated in FIG. 1. The bearing holding portion 11 is disposed adjacent to the impeller 2, the flange portion 11*a* extending radially outward from the bearing holding portion 11 is disposed to be opposed to the rotating plate 2*a* of the impeller 2, and parts near the outer circumferential end portion 11*b* of the flange portion 11*a* form part of the air path 6. These configurations are also similar to those in the first embodiment.

The present embodiment differs from the first embodiment in that the flange portion 11*a* is not formed from the two parts but is formed integrally with the bearing holding portion 11. Integrating the flange portion 11*a* with the bearing holding portion 11 can reduce the number of parts and improve rigidity.

As described so far, the bearing holding portion 11 made of metal can improve the heat conductivity and accelerate the heat dissipation of the bearings 10 through the flange portion 11*a*. Therefore, it is possible to provide the blower 1 capable of improving the heat dissipation of the bearings 10 disposed between the impeller 2 and the motor 4 and achieving extended lifespan without increasing the number of parts.

What is claimed is:

1. A blower comprising an integral assembly of a fan casing accommodating an impeller and a motor casing accommodating a motor that drives the impeller to rotate, for suctioning air in an axial direction of the fan casing from a radially central portion of the fan casing and delivering the air to an annular air path provided radially outward, wherein a rotor is assembled to one longitudinal end side of a motor shaft and the impeller is assembled to another longitudinal end side of the motor shaft, and a bearing rotatably supporting the motor shaft and a metal bearing holding portion holding the bearing are assembled, between the impeller and the motor, to the fan casing via an anti-vibration member, a tip end side of a flange portion of the bearing holding portion extending radially outward to the annular air path, which is disposed radially outward about the motor shaft, forms part of the annular air path, and a gap is provided between the flange portion of the bearing holding portion facing the annular air path and the fan casing, and wherein the anti-vibration member and the annular air path are axially between the flange portion and the motor.

2. The blower according to claim 1, wherein the flange portion is formed integrally with the bearing holding portion.

3. The blower according to claim 1, wherein the flange portion comprises an assembly of a first flange portion formed integrally with the bearing holding portion and an annular second ring-shaped flange portion superimposed on the first flange portion.

4. The blower according to claim 1, wherein the impeller comprises a plurality of first blades formed standing on one surface of a rotating plate facing an intake opening portion; and a plurality of second blades formed standing on the other surface of the rotating plate facing the flange portion.

* * * * *